US006960021B2

(12) United States Patent
Schneider et al.

(10) Patent No.: US 6,960,021 B2
(45) Date of Patent: Nov. 1, 2005

(54) RECLOSABLE PACKAGES WITH FRONT PANEL SLIDER-ZIPPER ASSEMBLY

(75) Inventors: John H. Schneider, Frankfort, IL (US); Steven Ausnit, New York, NY (US)

(73) Assignee: Illinois Tool Works Inc., Glenview, IL (US)

( * ) Notice: Subject to any disclaimer, the term of this patent is extended or adjusted under 35 U.S.C. 154(b) by 71 days.

(21) Appl. No.: 10/263,420

(22) Filed: Oct. 2, 2002

(65) Prior Publication Data

US 2004/0066990 A1 Apr. 8, 2004

(51) Int. Cl.[7] ..... B65D 33/16

(52) U.S. Cl. ..... 383/64; 383/61.2; 383/66; 383/203; 383/210; 383/210.1

(58) Field of Search ..... 383/64, 61.2–61.3, 383/66, 210–211, 210.1, 203–204

(56) References Cited

U.S. PATENT DOCUMENTS

| | | | | | |
|---|---|---|---|---|---|
| 4,335,817 | A | | 6/1982 | Bahr | |
| 5,461,845 | A | | 10/1995 | Yeager | |
| 5,681,115 | A | | 10/1997 | Diederich et al. | |
| 5,782,733 | A | | 7/1998 | Yeager | |
| 5,902,047 | A | * | 5/1999 | Yeager | 383/203 |
| 5,954,433 | A | | 9/1999 | Yeager | |
| 6,131,370 | A | | 10/2000 | Ausnit | |
| 6,264,366 | B1 | * | 7/2001 | Custer | 383/5 |
| 6,354,738 | B1 | * | 3/2002 | Buckman et al. | 383/5 |
| 6,402,376 | B1 | | 6/2002 | Bois | |
| 6,609,828 | B2 | * | 8/2003 | Schneider et al. | 383/204 |
| 6,652,436 | B1 | * | 11/2003 | Yeager et al. | 493/213 |
| 2002/0094138 | A1 | | 7/2002 | Schneider | |

FOREIGN PATENT DOCUMENTS

| | | | | |
|---|---|---|---|---|
| EP | 000528721 A | * | 2/1993 | 383/66 |
| EP | 1231155 A2 | | 8/2002 | |

* cited by examiner

*Primary Examiner*—Jes F. Pascua
(74) *Attorney, Agent, or Firm*—Ostrager Chong & Flaherty & Broitman P.C.

(57) ABSTRACT

A reclosable package having a slider-operated zipper wherein the contents of the package are accessed through the front wall of the package, not through the top of the package. The reclosable package comprises: a bag body comprising front and rear walls of bag making material; a flexible zipper joined to the front wall and not joined to the rear wall; and a slider mounted to the zipper, the slider being movable in a first direction along the zipper for opening the zipper and movable in a second direction along the zipper for closing the zipper. Alternatively, the flexible zipper is joined to the front wall along first and second zones of joinder disposed at different heights on the front wall, and is joined to the rear wall only in zones of joinder where the zipper is joined to both of the front and rear walls.

15 Claims, 7 Drawing Sheets

RECLOSABLE PACKAGES WITH FRONT PANEL SLIDER-ZIPPER ASSEMBLY

BACKGROUND OF THE INVENTION

This invention generally relates to slider-operated flexible zippers for use in reclosable pouches, bags or other packages of the type in which material, such as foodstuff, detergent, etc., may be stored.

Reclosable fastener assemblies are useful for sealing thermoplastic pouches or bags. Such fastener assemblies often include a plastic zipper and a slider. Typically, the plastic zippers include a pair of interlockable fastener elements, or profiles, that form a closure. As the slider moves across the profiles, the profiles are opened or closed. The profiles in plastic zippers can take on various configurations, e.g. interlocking rib and groove elements having so-called male and female profiles, interlocking alternating hook-shaped closure members, etc.

Conventional slider-operated zipper assemblies typically comprise a plastic zipper having two interlocking profiles and a slider for opening and closing the zipper. In one type of slider-operated zipper assembly, the slider straddles the zipper and has a separating finger at one end that is inserted between the profiles to force them apart as the slider is moved along the zipper in an opening direction. The other end of the slider is sufficiently narrow to force the profiles into engagement and close the zipper when the slider is moved along the zipper in a closing direction. Other types of slider-operated zipper assemblies avoid the use of a separating finger. For example, U.S. Pat. No. 6,047,450 discloses a zipper comprising a pair of mutually interlockable profiled structures, portions of which form a fulcrum about which the profiled structures may be pivoted out of engagement when lower edges of the bases are forced towards each other by the moving slider.

Reclosable bags are finding ever-growing acceptance as primary packaging, particularly as packaging for foodstuffs such as cereal, fresh vegetables, snacks and the like. Such bags provide the consumer with the ability to readily store, in a closed, if not sealed, package any unused portion of the packaged product even after the package is initially opened. To gain acceptance as a primary package for foodstuffs, it is virtually mandatory that the package exhibit some form of tamper evidence to protect the consumer and maintain the wholesomeness of the contained product. In addition, in many cases it is necessary that food product be hermetically packaged. This may readily be accomplished by forming a plastic bag of a film having the appropriate barrier properties. However, where the bag is provided with a zipper, a problem arises in properly sealing the bag at the opening to be closed by the zipper, since the zipper itself does not provide a hermetic seal. The presence of a slider on a zipper poses an additional impediment to hermetic sealing of the package since even in the fully closed park position, the opening end of the slider typically causes the zipper closure members to separate.

One solution to the problem off providing both tamper evidence and hermetic sealing is to manufacture packages wherein the slider-zipper assembly is enclosed by a header. Before anyone can open the zipper and tamper with the contents of the package, the header must be torn at least partly, leaving evidence to dissuade any consumer from buying that package. Also, since the header is contiguous with the bag body, the fully enclosed zipper does not interfere with hermetic sealing of the package.

Many existing form-fill-seal (FFS) machines operate on bag making film and do not incorporate equipment for attaching zipper assemblies to the bag making film. However, zipper application machines are available that can be coupled to the FFS machine to provide the zipper application function. In addition, a slider insertion device may be incorporated as part of the zipper application station. However, operators of FFS machines who do not wish to purchase a zipper applicator and a slider inserter require that bag making film with slider-zipper assemblies be available for purchase. This film can then be run through the FFS machine. Although the packager may need to modify his FFS machine to handle bag making film with slider-zipper assemblies attached, including providing clearance for the sliders to pass through the machine, the major capital investment of a zipper application system can be avoided.

There is a need for a reclosable package design whereby bag making film with preattached slider-zipper assemblies can be formed, filled and sealed without the FFS machine needing to perform any zipper application step.

BRIEF DESCRIPTION OF THE INVENTION

The present invention is directed to bag making film having slider-zipper assemblies fully attached to the film, to reclosable packages made from such bag making film, and to methods of manufacturing such reclosable packages. The package is designed with a tear-out section in the front wall or panel that provides ready access to the package contents.

One aspect of the invention is a resealable package comprising: a bag body having an interior space, the bag body comprising first and second walls of bag making material, the first wall opposing the second wall; a flexible zipper disposed between the first and second walls, the zipper being joined to the first wall and not joined to the second wall; and a slider mounted to the zipper, the slider being movable in a first direction along the zipper for opening the zipper and movable in a second direction along the zipper for closing the zipper.

Another aspect of the invention is a resealable package comprising: a bag body comprising first and second walls of bag making material; a flexible zipper disposed between the first and second walls, the zipper being joined to the first wall along first and second zones of joinder disposed at different heights on the first wall, and joined to the second wall only in zones of joinder where the zipper is joined to both of the first and second walls; and a slider mounted to the zipper, the slider being movable in a first direction along the zipper for opening the zipper and movable in a second direction along the zipper for closing the zipper.

A further aspect of the invention is a resealable package comprising: a bag body having an interior space, the bag body comprising first and second walls of bag making material, the first wall opposing the second wall; a zipper comprising first and second profiled closure members that are mutually engageable and disengageable; means for separating the interior space of the bag body into first and second compartments; and a slider mounted to the zipper for engaging opposing sections of the first and second closure members as the slider is moved in a first direction along the zipper and disengaging opposing sections of the first and second closure members as the slider is moved in a second direction along the zipper. The first compartment is bounded in part by a first portion of the first wall and not bounded by any portion of the second wall, and the second compartment is bounded in part by the second wall and a second portion of the first wall and is filled with product. The first and second portions of the first wall are mutually distinct. The separating means are connected to the first and second closure members. The slider is disposed inside the first compartment. The first portion of the first wall comprises a closed line of weakened tear resistance for providing access to the slider when the area bounded by the closed line of weakened tear resistance is removed.

Another aspect of the invention is a method of applying a slider-zipper assembly to bag making film, the slider-zipper assembly comprising first and second profiled closure members that are mutually interlocked, and first and second zipper flanges respectively connected to the first and second closure members. The method comprises the following steps: (a) placing a length of bag making film under tension; (b) placing a slider-zipper assembly on the tensioned length of bag making film in a predetermined position; (c) joining a portion of the first zipper flange to the bag making film in a first zone of joinder while the slider-zipper assembly is in the predetermined position; and (d) joining a portion of the second zipper flange to the bag making film in a second zone of joinder while the slider-zipper assembly is in the predetermined position. The first and second zones of joinder are located on opposite sides of the interlocked first and second closure members.

Another aspect of the invention is a resealable package comprising: a bag body having an interior space, the bag body comprising first and second walls of bag making material, the first wall opposing the second wall; a flexible zipper comprising first and second profiled closure members respectively joined to the first wall along first and second zones of joinder disposed at different heights on the first wall and not joined to the second wall; and a slider mounted to the zipper, the slider being movable in a first direction along the zipper for opening the zipper and movable in a second direction along the zipper for closing the zipper.

Yet another aspect of the invention is a bag making film having a multiplicity of slider-zipper assemblies attached thereto at spaced intervals therealong, each slider-zipper assembly comprising first and second profiled closure members that are mutually interlocked, first and second zipper flanges respectively connected to the first and second closure members, and a slider mounted to the first and second profiled closure members, each first zipper flange comprising a portion joined to the film in a respective first zone of joinder located on one side of the interlocked first and second closure members, and each second zipper flange comprising a portion joined to the film in a respective second zone of joinder located on the other side of the interlocked first and second closure members.

Other aspects of the invention are disclosed and claimed below.

DETAILED DESCRIPTION OF THE INVENTION

Figure 2:
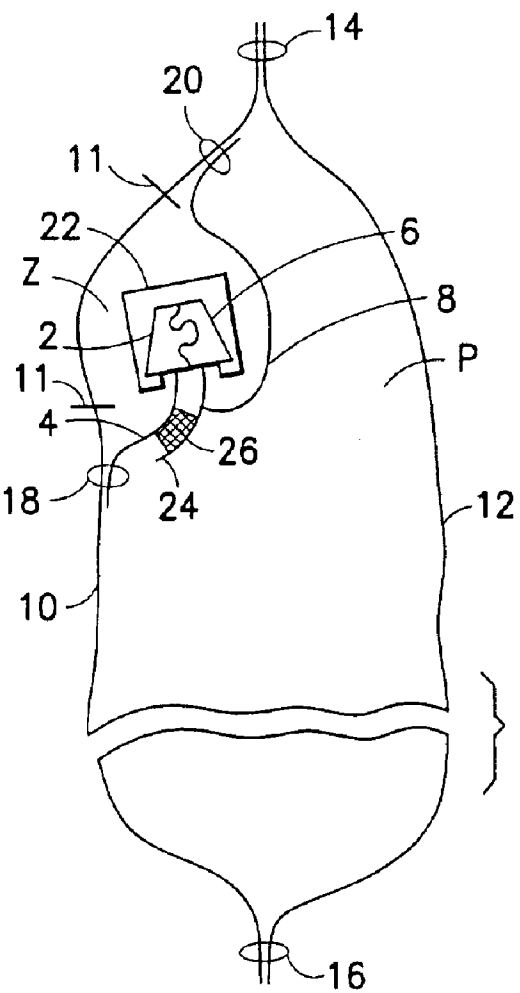
FIGS. 1–6 are schematics showing sectional views of reclosable packages in accordance with first through sixth embodiments of the invention respectively having a slider-zipper assembly inside a bag body. The ovals represent seals or seams formed by conduction heat sealing.

Reference will now be made to the drawings in which similar elements in different drawings bear the same reference numerals. FIGS. 1–6, 11, 14 and 15 depict various reclosable packages in accordance with respective embodiments of the invention. As will be made apparent below, the invention also encompasses embodiments other than those shown in the drawings. The embodiments depicted in the drawings share the following common features.

Each reclosable package depicted in FIGS. 1–6, 11, 14 and 15 comprises a bag body and a slider-zipper assembly. The bag body comprises a front wall 10 and a rear wall 12 having top edges joined at a top seam 14 and bottom edges joined at a bottom seam 16 by any conventional means, e.g., conduction heat sealing. Alternatively, the front and rear panels are made of a single sheet that is folded at one location and whose edges are sealed at another location. However, the concept of the invention encompasses the use of bag bodies comprising front and rear panels, the edges of which are joined on four sides to form top, bottom and two side seams; and bag bodies having front and rear walls connected by respective gusseted side walls. The concept of the invention also encompasses the use of bag bodies having a pair of side seams, a bottom seam and a fold in place of a top seam, and bag bodies having a pair of side seams, a top seam and a fold in place of a bottom seam. In addition, bag bodies comprising a bottom wall contiguous with the bottom edges of the front and rear walls and the bottom edges of a pair of side walls (optionally gusseted) can be used.

The walls of the bag body comprise thermoplastic web material or film. The bag walls may be formed of various types of thermoplastic material, such as low-density polyethylene, substantially linear copolymers of ethylene and a C3–C8 alpha-olefin, polypropylene, polyvinylidene chloride, mixtures of two or more of these polymers, or mixtures of one of these polymers with another thermoplastic polymer. The person skilled in the art will recognize that this list of suitable materials is not exhaustive. The preferred thermoplastic materials are polyethylene and polypropylene.

The slider-zipper assemblies depicted in FIGS. 1–6, 11, 14 and 15 have the following common features. The zipper comprises two zipper halves that are heat sealed, bonded or otherwise joined to the front wall 10 of the body bag. Typically, one zipper half comprises an interlockable profiled closure member 2 having a male profile and the other zipper half comprises an interlockable profiled closure member 6 having a female profile designed to receive and interlock with the male closure member 2. Many different rib-and-groove arrangements are known in the art. Alternatively, the zipper may comprise alternating hook-shaped closure members that interleave when the zipper halves are brought together. The present invention may employ any type of flexible plastic zipper suitable for being operated by manipulation of a slider.

Each zipper half also comprises a flange or fin 4 having one end connected to the profiled closure member 2 and a flange or fin 8 having one end connected to the profiled closure member 6. A distal portion of each of the flanges 4 and 8 is joined to the front wall 10 of the bag body along respective zones of joinder that extend the length of the zipper. The joinder zones may be formed by conduction heat sealing, application of adhesive or any other suitable technique for joining thermoplastic materials.

Each embodiment further includes a slider 22 mounted on the zipper to facilitate its opening and closing. To this end, moving the slider toward one side causes opposing sections of the profiled closure members 2 and 6 to disengage and moving the slider toward the opposite side brings opposing sections of the closure members into engagement. The slider for opening or closing the reclosable zipper is typically shaped so that the slider straddles the zipper profiles. In a straddling slider, the ends of the slider are open to allow the zipper to pass through. The slider may be made in multiple parts and welded together or the parts may be constructed to be snapped together. The slider may also be of one-piece construction. The slider can be made using any desired method, such as injection molding. The slider can be molded from any suitable plastic, such as nylon, polypropylene, polystyrene, acetal, polyketone, polybutylene terephthalate, high-density polyethylene, polycarbonate, or ABS.

In each of the embodiments depicted in FIGS. 1-6, the slider-zipper assembly is located inside the bag body. The distinctions between these different embodiments will now be described.

Figure 1:
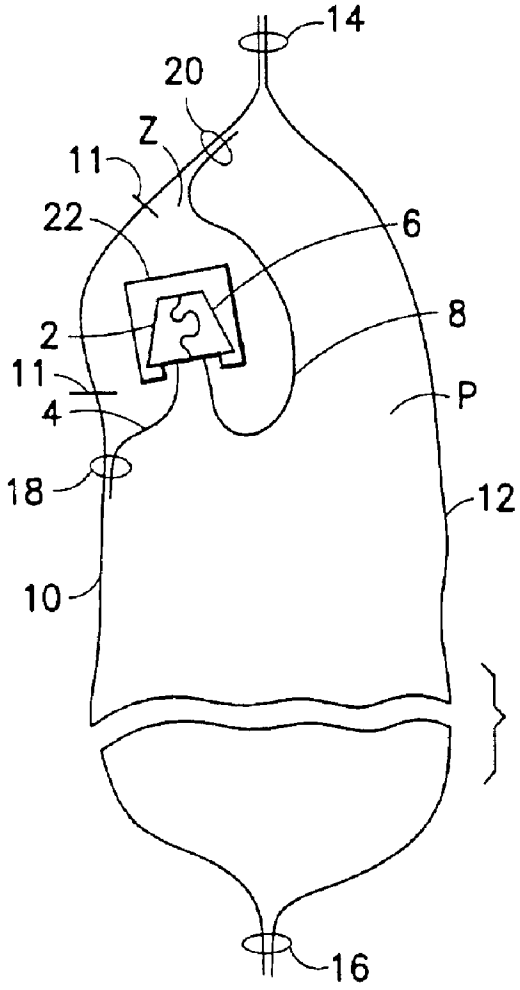

A reclosable package in accordance with one embodiment of the invention is shown in FIG. 1. The zipper is attached to the front wall 10 of the bag body by means of conduction heat sealing. More specifically, the zipper comprises a short flange 4 heat sealed to the front wall 10 at a first zone of joinder located at a first height, forming a permanent seal 18, and a long flange 8 heat sealed to the front wall 10 at a second zone of joinder located at a second height greater than the first height, forming a permanent seal 20. It should be appreciated that each permanent seal 18 and 20 is a band of joined, e.g., fused, material that extends from one end of the zipper to the other, thereby securing the zipper to the bag body along the length of the zipper.

As seen in FIG. 1, the long flange 8 is wrapped around the back of the zipper and joined to the front wall 10 at a height above the top of the slider 22. Although FIG. 1 shows an embodiment wherein the long flange is connected to a closure member 6 having a female profile, the closure members of the zipper can be reversed so that the long flange is connected to the closure member with male profile instead. Although not shown in FIG. 1, the person skilled in the art will appreciate that the edges at the opposing ends of the zipper flanges must also be joined to the front wall 10, thereby separating the enclosed bag body into a product compartment P on the product side of the zipper and a zipper compartment Z outside the zipper. Optionally, the zipper may be as wide as the package so that the ends of the zipper can be captured in and sealed by the package side seals. In accordance with an alternative embodiment shown in FIG. 5, a distal end section of the flange 8 can be captured in and sealed by the top seal 14, in which case the distal end section of the flange 8 is sandwiched between and joined to the front wall 10 and the rear wall 12.

To facilitate opening of the package by the consumer, a closed line 11 (e.g., oval shaped) of weakened tear resistance is formed in the section of front wall 10 that spans the zones of joinder 18 and 20. For example, such a closed line of weakened tear resistance may be formed by perforating the bag making material at spaced intervals along a closed line during the bag making process. In the sectional views of FIGS. 1 and 5, the top and bottom of the closed line of weakening are indicated by lines designated with numeral 11. When the package is in an unopened state, the consumer can access the slider by tearing the front wall 10 along the closed line 11 and removing the section of bag material encompassed by that tear line. Initially the slider 22 will be in the fully closed park position. After removing the tear-out section of the front wall 10, the consumer can grip the slider 22 and move it in the opening direction, thereby opening the zipper and accessing the package contents inside the product compartment P.

The presence of perforations means that the front wall section between the permanent seals 18 and 20 cannot provide hermetic sealing for the package. Since, as previously discussed, the zipper does not provide means for hermetic sealing, additional steps must be taken in order to provide hermetic sealing.

The embodiment shown in FIG. 2 differs from that shown in FIG. 1 in the provision of means for hermetic sealing. More specifically, the zipper is constructed with a flange extension 24 having one end connected to the long zipper flange 8 and a peel seal 26 is made between the short flange 4 and the flange extension 24. The peel seal 26 provides hermetic sealing of the product compartment P even when the front wall section between the permanent seals 18 and 20 is perforated. The flange extension may be integral with the flange or consist of a separate strip.

In the embodiment shown in FIG. 3, the zipper is constructed with a flange extension 28 having one end connected to the long zipper flange 8 and a peel seal 30 is made between the front wall 10 and a distal portion of the flange extension 28 at a location below the permanent seal 18. The peel seal 30 provides hermetic sealing of the product compartment P even when the front wall section between the permanent seals 18 and 20 is perforated.

Figure 4:
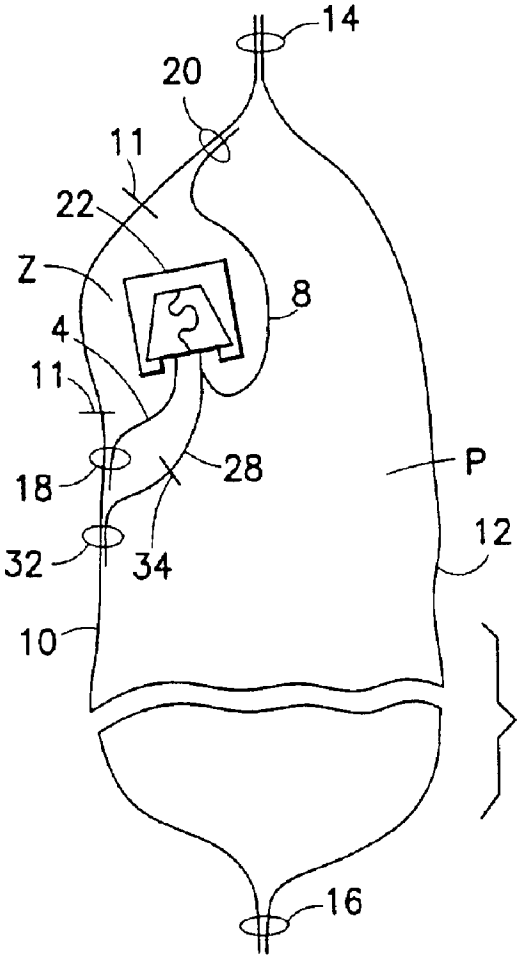
Figure 3:
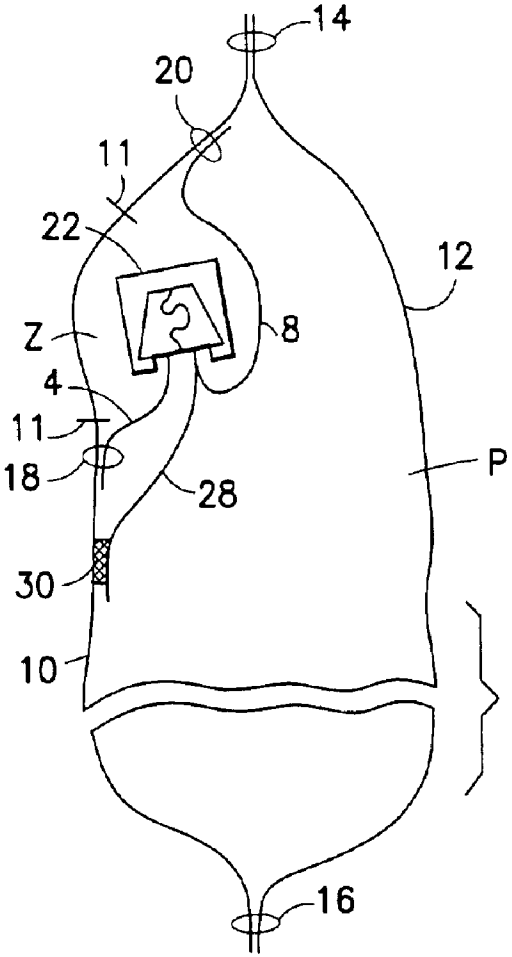

The embodiment shown in FIG. 4 differs from that shown in FIG. 3 in that the distal portion of the flange extension 28 is joined to the front wall 10, e.g., by conduction heat sealing, instead of being peel sealed to the front wall. This zone of joinder forms another permanent seal 32 located below the permanent seal 18. The bag walls 10 and 12 are formed of a suitable plastic film material for the product to be contained within the package. For example, the film may be a laminate or coextrusion comprising a gas barrier layer and/or a low-melting-point sealant layer. The flange 8 and flange extension 28 may be formed by lamination, coextrusion or monolayer extrusion, and may comprise a barrier layer contained within tie (or adhesive) layers and low-melting-point sealant layers. In this manner, flange 8, flange extension 28, and bag walls 10, 12 cooperate in maintaining a barrier completely around the product to permit the hermetic sealing of the product within compartment P. In addition, one of the flange 8 may comprise a low-melting-point material to facilitate controlling the sealing of the flange to the front wall 10 as required. The low-melting-point sealant layers facilitate sealing the flange to the bag walls. The barrier layer may provide resistance to moisture and/or gases such as oxygen, carbon dioxide, nitrogen and other gases from entering (or exiting) the package and permits the package to be hermetically sealed if required. The hermetic sealing of the package contents is independent of the zipper and will be maintained whether the zipper is opened or closed as long as the bag walls, flange 8 and flange extension 28 remain intact.

As indicated in FIG. 4, the flange extension 28 has a line of weakened tear resistance 24 that runs along the flange generally parallel to the zipper longitudinal axis. As in flange extension 24, the flange extension 28 may be integral or separate. The terminal section of the flange extension 28 will remain joined to the front wall 10 where the line of weakened tear resistance 34 is ruptured. The line of weakness 34 may, for example, take the form of a scoreline in the flange extension 28; or a line of spaced perforations extending along the flange extension 28. To maintain the barrier of flange extension 28, the line of perforations is capped by a frangible strip (not shown in FIG. 2) of lightweight material, as disclosed in U.S. Pat. No. 5,023,122. This frangible strip seals the perforations, but tears readily when the perforated flange is ruptured along the perforation line. The sealing strip may be heat sealed to the perforated flange or the sealing strip may be adhesive backed to allow the strip to be bonded to the flange by adhesive. Alternatively, the sealing strip may be provided by extruding a thin layer of material over the perforations. The details of how to manufacture a sealing strip for capping perforations in a substrate are fully disclosed in U.S. Pat. No. 5,023,122, which is incorporated by reference herein.

After the tear-out section of the front wall is removed and the zipper is initially opened by a consumer, the flange extension 28 still prevents access to the package compartment P. The intact flange extension 28 provides hermetic sealing. By bearing down on the flange 28 or by pulling closure member 6 and the opposing section of front wall 10 apart, the line of weakness 34 can be ruptured, thereby providing access to the package compartment.

Figure 6:
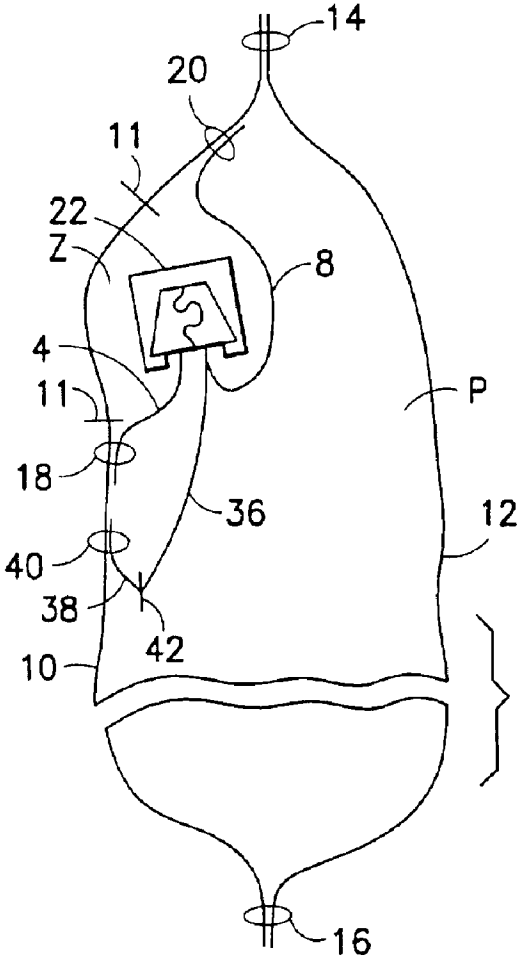

In the embodiment depicted in FIG. 6, a flange extension is formed into a generally V-shaped section with a line of weakness 42 in the cusp of the V. The legs of the V are designated 36 and 38 in FIG. 6, with one end of leg 36 being connected to flange 8 and one end of leg 38 being joined to the front wall 10 by a zone of joinder to form a permanent seal 40. The other ends of the legs 36 and 38 are connected at the cusp of the V. The line of weakness 42 is formed at this junction of legs 36 and 38. The package may then be readily opened by the consumer simply running a finger along the cusp to rupture the line of weakness 42. However, if the package is subjected to high internal pressure, the weakened line may be moved toward seal point 40, as shown in FIG. 6, thereby providing a hinge effect enabling the weakened line to withstand a greater internal force.

The present invention also encompasses methods of applying a slider-zipper assembly to bag making film. One method, which is useful in the manufacture of the embodiments depicted in FIGS. 1–6, comprises the following steps: (a) placing a length of bag making film under tension; (b) placing a slider-zipper assembly on the tensioned length of bag making film in a predetermined position; (c) joining a portion of one zipper flange to the bag making film in a first zone of joinder while the slider-zipper assembly is in the predetermined position; and (d) joining a portion of the other zipper flange to the bag making film in a second zone of joinder while the slider-zipper assembly is in the predetermined position. At this juncture in the manufacturing process, the first and second zones of joinder are located on opposite sides of the interlocked first and second closure members of the zipper. In accordance with a further aspect of the invention, the bag making film is weakened, e.g., by perforation, along a closed line to form a tear-out section in the front wall of the bag body directly opposite to the slider-zipper assembly. This tear-out section should be sized and shaped to allow the consumer to easily manipulate the slider back and forth via the opening formed by removal of the tear-out section. The weakening operation can be performed before or after application of slider-zipper assemblies to the film.

Figure 5:
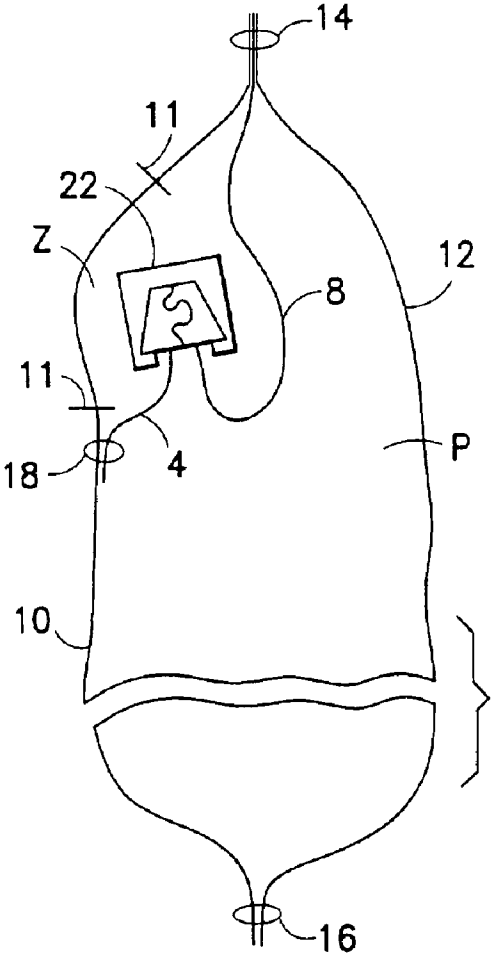
Figure 7:
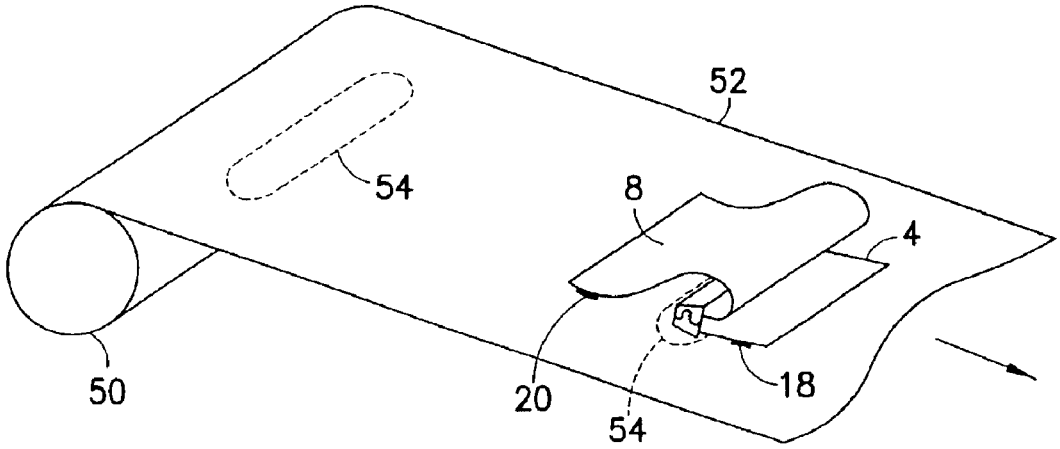
FIG. 7 is a schematic showing a method of applying a slider-zipper assembly to bag making film as a preliminary to forming, filling and sealing the package depicted in FIG. 1.

FIG. 7 shows a method of applying a slider-zipper assembly to bag making film as a preliminary to forming, filling and sealing the package depicted in FIG. 1 (or the package depicted in FIG. 5). In the first stage of manufacture depicted in FIG. 7, a web of bag making film 52 is unwound from a roll 50 and fed under tension in a machine direction toward a form-fill-seal machine (not shown). The direction of web advancement is indicated by the arrow in FIG. 7. The web may be advanced one package increment at regular intervals of time. At a first station, the film 52 is perforated at spaced intervals along a closed line 54 or lines 11 as indicated in FIGS. 1–6. At the next station, a slider-zipper assembly is guided to a transverse position overlying the perforated region of the tensioned film; and the flanges 4 and 8 are joined to the film 52 along mutually parallel bands or zones, e.g., by two pairs of opposed heat sealing jaws (not shown). The slider-zipper assembly is fed to the application station with the flange 8 already folded over as seen in FIG. 7. Permanent seals 18 and 20 are thus formed on opposite sides of the zipper closure members. Then the film with applied slider-zipper assembly is advanced toward a conventional vertical form-fill-seal machine, where the package can be formed, filled and sealed.

Figure 8:
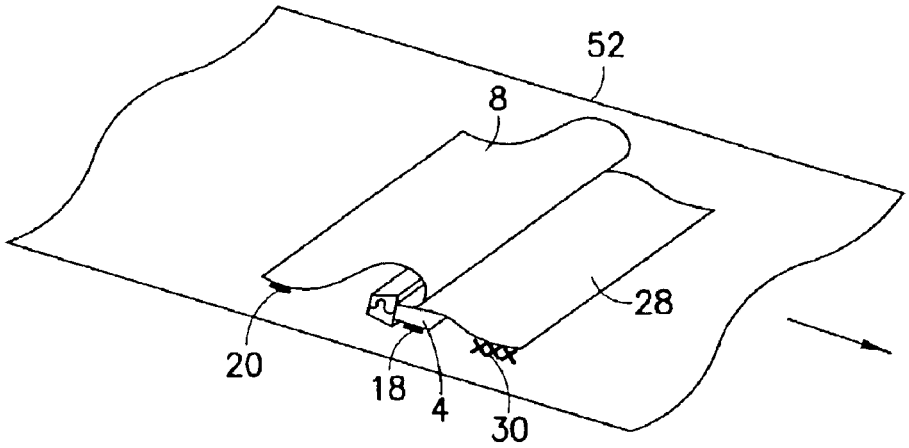
FIG. 8 is a schematic showing a method of applying a slider-zipper assembly to bag making film as a preliminary to forming, filling and sealing the package depicted in FIG. 3.

FIG. 8 shows a method of applying a slider-zipper assembly to bag making film as a preliminary to forming, filling and sealing the package depicted in FIG. 3. In accordance with this method, permanent seals 18 and 20 are again made, joining the zipper flanges 4 and 8 to the film 52. The method differs from that depicted in FIG. 7 in several respects. First, care must be taken that the flange 4 is not joined to the flange extension 28 during formation of the permanent seal 18. This can be accomplished, e.g., by pressing the film, flange and flange extension between a heated sealing jaw below the film and an unheated sealing jaw above the flange extension, with the temperature of the heated sealing jaw being adjusted tom achieve the desired result.

Other differences are that the zipper is formed with a flange extension 28 and a layer of peel seal material is applied on the side of flange extension 28 that faces the film 52. The peel seal material is activated, e.g., by application of heat and pressure, to form a peel seal 30 between the film 52 and the flange extension 28, being joined to both. For example, the zipper and bag making film can be made from low-density polyethylene (LDPE), while the peel seal material can comprise a blend of LDPE and polybutylene. Activation of the peel seal material and formation of the permanent seals can be carried in one machine operation using three sets of heated jaws. Again, the closed line of weakened tear resistance can be formed on the film before or after application of the slider-zipper assembly.

For the embodiment depicted in FIG. 4, in place of the peel seal activation shown in FIG. 8, the flange extension 28 will, concurrently with the formation of permanent seals 18 and 20, be joined to the front wall 10, forming a third permanent seal 32.

Figure 9:
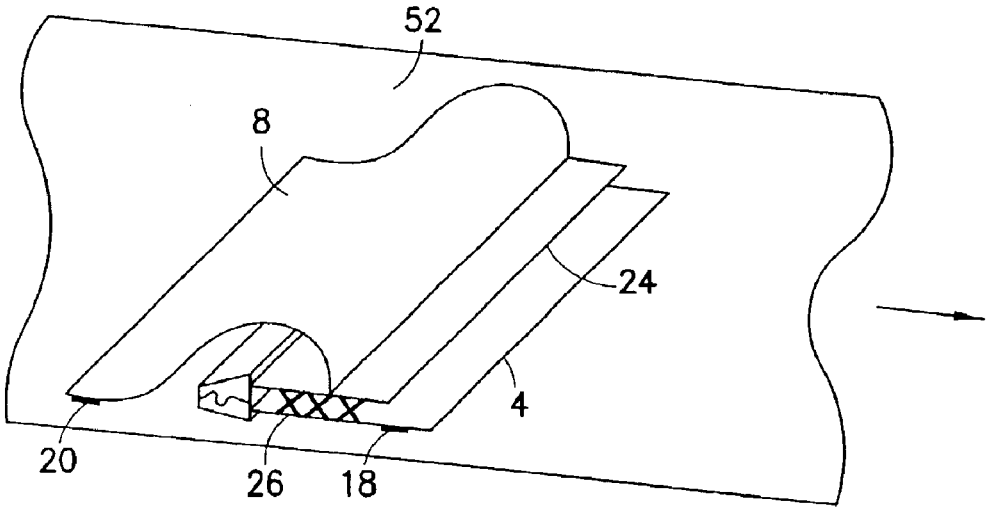
FIG. 9 is a schematic showing a method of applying a slider-zipper assembly to bag making film as a preliminary to forming, filling and sealing the package depicted in FIG. 2.

FIG. 9 shows a method of applying a slider-zipper assembly to bag making film as a preliminary to forming, filling and sealing the package depicted in FIG. 2. Again, the zipper flanges 4 and 8 are joined to film 52 in a manner that forms permanent seals 18 and 20. In this case, the zipper is formed with a flange extension 24 connected to the flange 8 and a peel seal 26 is formed between the flange 4 and the extension flange 24. The peel seal material can be activated concurrently with formation of the permanent seals 18 and 20.

Figure 10:
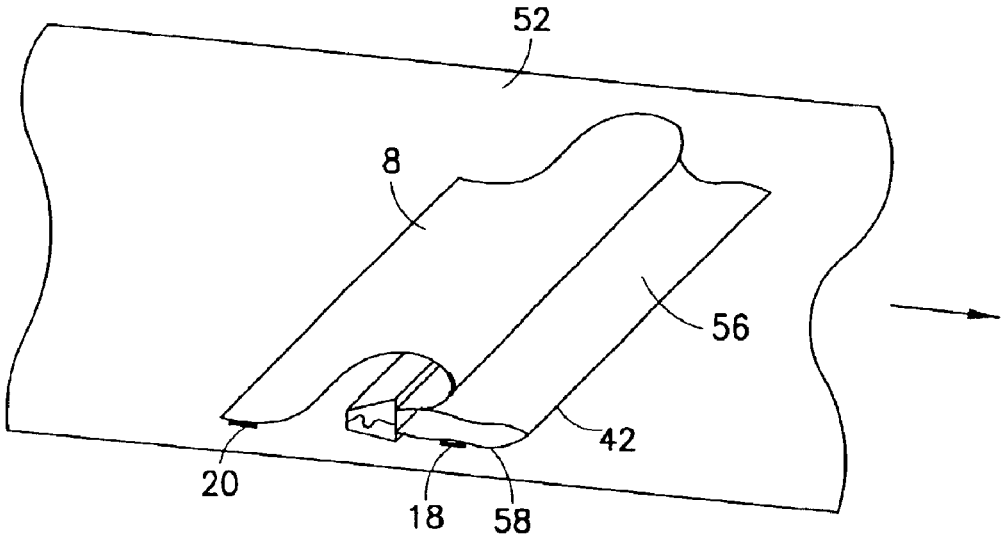
FIG. 10 is a schematic showing a method of applying a slider-zipper assembly to bag making film in accordance with a seventh embodiment of the invention.

FIG. 10 shows a method of applying a slider-zipper assembly to bag making film preliminary to forming, filling and sealing a package that is a variation of the embodiment depicted in FIG. 6. In this variation, the flange extension 56 and the short flange 58 are formed as a continuous membrane having a line of weakened tear resistance 42 at the junction of the flange extension and short flange. To manufacture this embodiment, the zipper application operation is substantially the same as that shown in FIG. 7 and previously described, namely, the joinder of the flanges 8 and 58 to the front wall 10 along two bands that are spaced apart, thereby forming the permanent seals 20 and 18 respectively.

Figure 11:
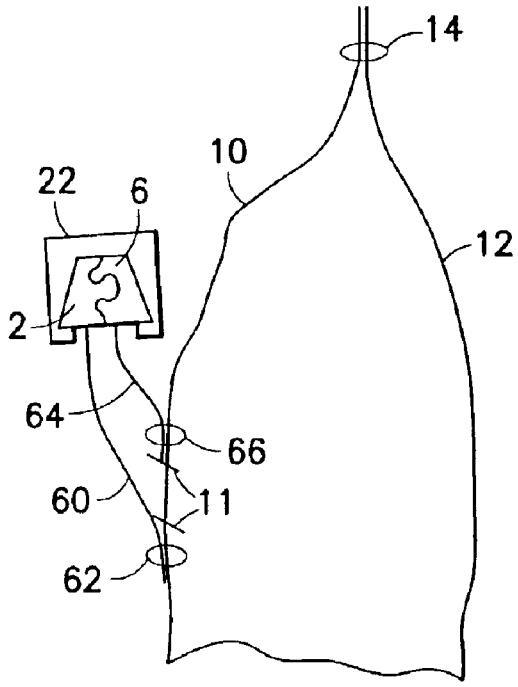
FIGS. 11, 14 and 15 are schematics showing sectional views of reclosable packages in accordance with seventh through ninth embodiments of the invention respectively having a slider-zipper assembly outside a bag body. Again the ovals represent seals or seams formed by conduction heat sealing.
Figure 14:
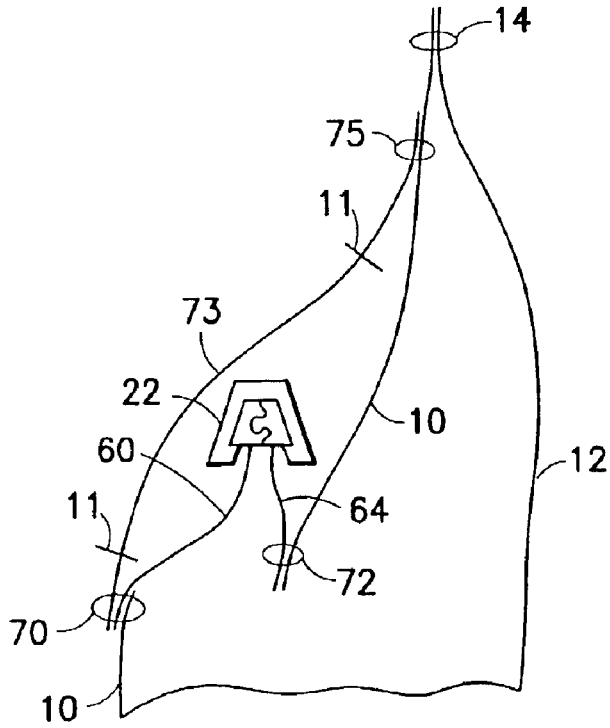
Figure 15:
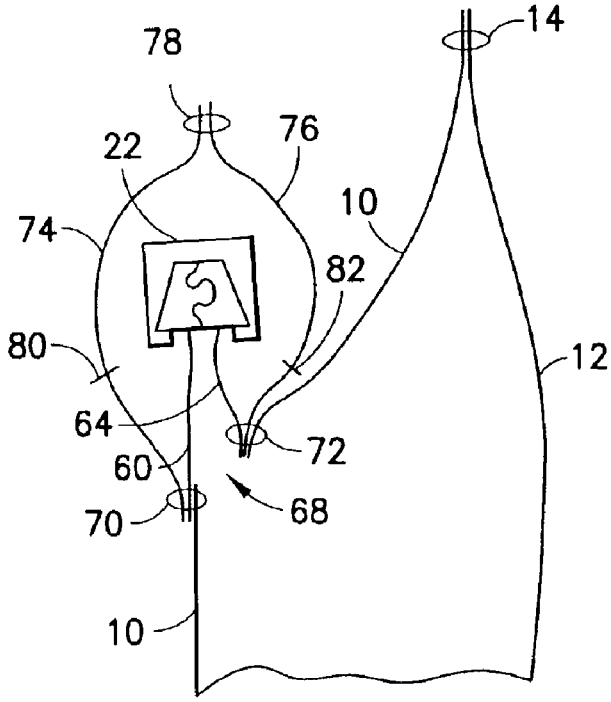

In the embodiments depicted in FIGS. 1–6, the slider-zipper assembly is attached to the front wall and inside the bag body. Alternatively, the slider-zipper assembly can be attached to the front wall and outside of the bag body. FIGS. 11, 14 and 15 show sectional views of reclosable packages in accordance with three such embodiments.

In the embodiment shown in FIG. 11 the zipper is attached to the front wall 10 of the bag body by means of conduction heat sealing. More specifically, the zipper comprises a short flange 64 heat sealed to the front wall 10 at a first zone of joinder located at a first height, forming a permanent seal 66, and a long flange 60 heat sealed to the front wall 10 at a second zone of joinder located at a second height lower than the first height, forming a permanent seal 62. It should be appreciated that each permanent seal 62 and 66 is a band of joined, e.g., fused, material that extends from one end of the zipper to the other, thereby securing the zipper to the bag body along the length of the zipper.

To facilitate opening of the package by the consumer, a closed line 11 (e.g., oval shaped) of weakened tear resistance is formed in the section of front wall 10 that spans the zones of joinder 62 and 66. For example, such a closed line of weakened tear resistance may be formed by perforating the bag making material at spaced intervals along a closed line during the bag making process. In the sectional views of FIG. 11, the top and bottom of the closed line of weakening are indicated by lines designated with numeral 11. After the zipper is opened by operation of the slider, the consumer can gain access to the package compartment by removing the tear-out section. This arrangement does not provide a hermetic seal.

To stabilize the zipper and provide slider end stops, the zipper ends can be sealed to the front wall. In the embodiment shown in FIG. 11, the zipper ends as well as the length of the zipper flange edges are sealed to the front wall. This can be accomplished in a number of ways. In accordance with one method, the low-melting-point sealant material used to attached the zipper to the film would cover the back surfaces of the zipper that confront the film. For example, for the zipper of the embodiment shown in FIG. 11 is shown by itself in FIG. 12 with its rear surfaces coated low-melting-point sealant material, namely coating 84 on the entire back surface of the rear zipper part including closure member 6 and flange 64, and coating 86 on the entire surface of the flange 60 of the front zipper part from the distal edge of the flange 60 to a location even with the distal edge of flange 64 of the rear zipper part.

Figure 12:
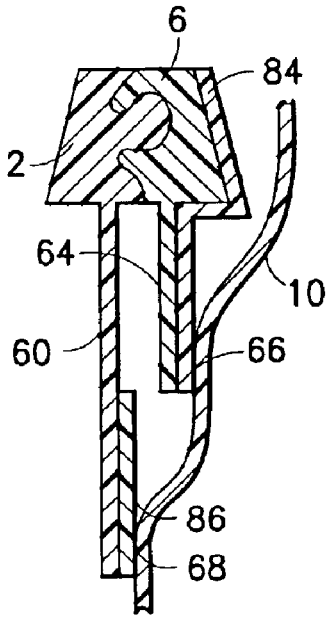
FIG. 12 is a schematic showing an end view of the zipper employed in the embodiment of FIG. 11, the zipper having layers of low-melting-point sealant material on surfaces confronting the front wall of the bag body.
Figure 13:
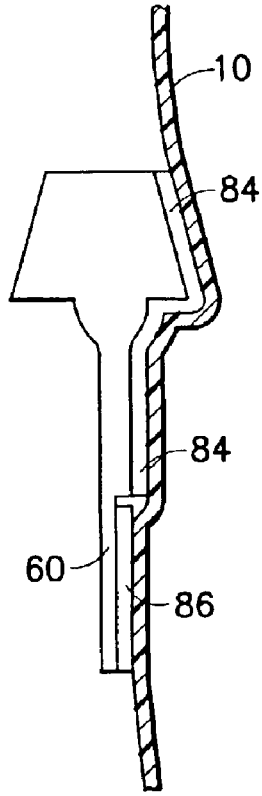
FIG. 13 is a schematic showing an end view of the zipper of FIG. 12 sealed to the front wall of the bag body.

FIG. 12 is a sectional view showing how the zipper (not hatched for visual clarity) is attached to the front wall 10 along the majority of the length of the zipper, while FIG. 13 is an end view of the zipper showing how the ends of the zipper are attached to the front wall 10 in a manner different than that of the mid-section. As seen in FIG. 12, a longitudinal band-shaped portion of the flange 60 is sealed to the front wall 10 in the zone of joinder 62, while a longitudinal band-shaped portion of the flange 64 is sealed to the front wall 10 in the zone of joinder 66. The closure member 6 is not sealed to the front wall 10 to allow the slider to travel freely along the length of the zipper. As seen in FIG. 13, however, each end of the zipper is sealed to the front wall 10 along the full height of the zipper by the sealant layers 84 and 86. Although not shown in FIG. 13, the zipper closure members will also be crushed at the ends so that the ends of closure members 2 and 6 become fused. Fusing the zipper parts at the ends prevents accidental disengagement of closure member 2 from closure member 6.

Although FIGS. 11–13 show the closure member 6 having a female profile as being the rear zipper part, it makes no difference which closure member is in the rear. A zipper wherein the closure member with the female profile has the long flange and the closure member with the male profile has the short flange would work equally well.

Another embodiment having the slider-zipper assembly attached on the outside of the front wall 10 of the bag body is shown in FIG. 14. In this embodiment the zipper flanges 60 and 64 are joined to the front wall 10 in respective zones of joinder that form permanent seals 70 and 72 lying on opposite sides of a cut in the front wall. The slider-zipper assembly is covered by a cover strip 73 whose peripheral edge is sealed to the front wall 10. That sealed periphery includes a top edge joined in a zone of joinder that forms a permanent seal 75 and a bottom edge joined to the front wall at the permanent seal 70. Alternatively, the top edge of the cover strip 73 can be joined to the front wall at the fin seal 14. The cover strip is provided with a closed line 11 of weakened tear resistance that defines a removable tear-out section. As previously described, removal of the tear-out section gives the consumer access to the package contents.

Yet another embodiment having the slider-zipper assembly attached on the outside of the front wall 10 of the bag body is shown in FIG. 15. This embodiment differs from that depicted in FIG. 14 in that the cover strip is replaced by a header, which encloses the slider zipper assembly. The header may comprise a front header panel 74 and a rear header panel 76. The top edges of the front and rear header panels 74 and 76 are joined by conduction heat sealing to form a permanent fin seal 78. Alternatively, the header panels could be formed as a single web folded over and having opposing edges joined to the front wall 10 at permanent seals 70 and 72.

To open the package shown in FIG. 15, the consumer must remove the header and then operate the slider to open the zipper. Tearing off of the header is facilitated by providing respective lines of weakened tear resistance, designated 80 and 82 in FIG. 15. The lines of weakened tear resistance 80 and 82 extend into the page, as seen in FIG. 15, and are preferably located at a height below the height of the bottom of the slider, so that when the header is torn away, the slider is accessible by the consumer and can be easily gripped between a thumb and a forefinger without obstruction or interference from the remainder of the header. The fin seal 78 forms a reinforcement that facilitates removal of the header. This heat-sealed reinforced region can be easily gripped by the consumer to tear off the header.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "package" means a container, bag, pouch or other receptacle for objects, material or stuff. A container, bag, pouch or other receptacle is deemed to be a package even if not yet packed with objects, material or stuff. As used in the claims, the verb "joined" means fused, bonded, sealed, or adhered, whether by application of heat and/or pressure, application of ultrasonic energy, application of a layer of adhesive material or bonding agent, interposition of an adhesive or bonding strip, etc. As used in the claims, the term "wall" is used in a broad sense to include both a discrete piece of bag making material and a portion of a discrete piece of bag making material. In addition, as used in the claims, the terms "flange" and "flange extension" are intended to encompass flanges and extensions that are integrally formed with each other and with the profiled closure members, as well as separate pieces joined to each and to the profiled closure members.

What is claimed is:

1. A reclosable package comprising:

a bag body having an interior space, said bag body comprising first and second walls of bag making material, said first wall opposing said second wall, and said first and second walls being joined to each other at a top seam and at a bottom seam;

a flexible zipper joined to said first wall and not joined to said second wall; and a slider mounted to said zipper, said slider being movable in a first direction along said zipper for opening said zipper and movable in a second direction along said zipper for closing said zipper, wherein said zipper comprises first and second zipper parts that are mutually engageable to close said zipper and mutually disengageable to open said zipper, said first zipper part comprising a first profiled closure member and a first flange connected to said first closure member, and said second zipper part comprising a second profiled closure member that is interlockable with said first closure member and a second flange connected to said second closure member, wherein a band-shaped area of said first flange is joined to a confronting first band-shaped area of said first wall in a first zone of joinder and a band-shaped area of said second flange is joined to a confronting second band-shaped area of said first wall in a second zone of joinder, said first and second zones of joinder being disposed at different heights on said first wall below said top seam and above said bottom seam, wherein said first and second profiled closure members are disposed in said interior space between said first and second walls, and wherein said first and second flanges extend away from said first and second closure members in substantially the same direction at the respective connections to said first and second closure members when said zipper is closed.

2. The reclosable package as recited in claim 1, wherein said zipper is located in said interior space of said bag body.

3. The reclosable package as recited in claim 2, wherein said first wall comprises a closed line of weakened tear resistance positioned to allow access to said slider when a section encompassed by said closed line is removed.

4. The reclosable package as recited in claim 3, wherein said closed line of weakened tear resistance comprises spaced perforations.

5. The reclosable package as recited in claim 1, further comprising a flange extension having one end connected to said second flange, and a peel seal between said flange extension and said first flange.

6. The reclosable package as recited in claim 1, further comprising a flange extension having one end connected to said second flange, and a peel seal between said flange extension and said first wall.

7. The reclosable package as recited in claim 1, wherein first and second ends of said zipper are joined to said first wall in third and fourth zones of joinder respectively, said third and fourth zones of joinder being contiguous with and generally perpendicular to said first and second zones of joinder, said third and fourth zones of joinder each including joinder to end segments of said first and second flanges and joinder to an end segment of said second closure member.

8. The reclosable package as recited in claim 7, wherein said first and second closure members are crushed together at said first and second ends of said zipper.

9. The reclosable package as recited in claim 1, wherein said first zone of joinder is higher on said first wall than said second zone of joinder, and said first flange is longer than said second flange in a plane transverse to the length direction of said zipper.

10. The reclosable package as recited in claim 9, wherein said first flange reverses direction.

11. A reclosable package comprising:

a bag body having an interior space, said bag body comprising first and second walls of bag making material, said first wall opposing said second wall;

a flexible zipper comprising first and second zipper parts that are mutually engageable to close said zipper and mutually disengageable to open said zipper, said first zipper part comprising a first profiled closure member and a first flange connected to said first closure member, and said second zipper part comprising a second profiled closure member that is interlockable with said first closure member and a second flange connected to said second closure member, wherein a band-shaped area of said first flange is joined to said first wall in a first zone of joinder and a band-shaped area of said second flange is joined to said first wall in a second zone of joinder, said first and second zones of joinder being disposed at different heights on said first wall;

a slider mounted to said zipper, said slider being movable in a first direction along said zipper for opening said zipper and movable in a second direction along said zipper for closing said zipper; and a flange extension having one end connected to said second flange, wherein a band-shaped area of said flange extension is joined to said first wall in a third zone of joinder disposed at a height lower than the heights of said first and second zones of joinder.

12. The reclosable package as recited in claim 11, wherein said flange extension comprises a line of weakened tear resistance.

13. A reclosable package comprising:

a bag body having an interior space, said bag body comprising first and second walls of bag making material, said first wall opposing said second wall, and said first and second walls being joined to each other at a top seam;

a zipper comprising first and second profiled closure members that are mutually engageable and disengageable;

means for separating said interior space of said bag body into first and second compartments, said first compartment being bounded in part by a first portion of said first wall and not bounded by any portion of said second wall, and said second compartment being bounded in part by said second wall and a second portion of said first wall and being filled with product, said separating means being connected to said first and second closure members of said zipper, and comprising a first flange connected to said first closure member and a second flange connected to said second closure member, each of said first and second flanges being joined to respective confronting band-shaped areas of said first wall at respective heights below said top seam and being not joined to said second wall, and said first and second flanges extending away from said first and second closure members in substantially the same direction at the respective connections to said first and second closure members when said first and second profiled closure members are mutually engaged; and a slider mounted to said zipper for engaging opposing sections of said first and second closure members as said slider is moved in a first direction along said zipper and disengaging opposing sections of said first and second closure members as said slider is moved in a second direction along said zipper, wherein said slider is disposed inside said first compartment, and said first portion of said first wall comprises a closed line of weakened tear resistance for providing access to said slider when the area bounded by said closed line of weakened tear resistance is removed.

14. The reclosable package as recited in claim 13, wherein said first flange is longer than said second flange in a plane transverse to the length direction of said zipper.

15. The reclosable package as recited in claim 14, wherein said first flange reverses direction.

* * * * *